US009273892B2

(12) United States Patent
Lee

(10) Patent No.: US 9,273,892 B2
(45) Date of Patent: Mar. 1, 2016

(54) ICE MAKER FOR A REFRIGERATOR

(75) Inventor: Jung Owan Lee, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 235 days.

(21) Appl. No.: 13/824,477

(22) PCT Filed: Sep. 20, 2011

(86) PCT No.: PCT/KR2011/006922
§ 371 (c)(1),
(2), (4) Date: Mar. 18, 2013

(87) PCT Pub. No.: WO2012/039568
PCT Pub. Date: Mar. 29, 2012

(65) Prior Publication Data

US 2013/0180279 A1 Jul. 18, 2013

(30) Foreign Application Priority Data

Sep. 20, 2010 (KR) ..... 10-2010-0092353

(51) Int. Cl.
*F25C 1/00* (2006.01)
*F25C 5/08* (2006.01)
*F25C 1/04* (2006.01)

(52) U.S. Cl.
CPC .... *F25C 5/08* (2013.01); *F25C 1/04* (2013.01)

(58) Field of Classification Search
CPC ..... F25C 5/08; F25C 1/04; F25C 1/00
USPC ..... 62/73, 351
See application file for complete search history.

(56) References Cited

U.S. PATENT DOCUMENTS

2004/0194480 A1* 10/2004 Kim ..... F25C 1/04 62/135
2010/0031679 A1* 2/2010 Park ..... F25C 1/04 62/129

FOREIGN PATENT DOCUMENTS

JP 11-316070 11/1999
JP 11316070 A * 11/1999 ..... F25C 1/00
KR 10-2003-0015055 2/2003
KR 20030015055 A * 2/2003 ..... F25C 1/24

(Continued)

OTHER PUBLICATIONS

International Search Report for international application No. PCT/KR2011/006922, dated Jun. 1, 2012 (4 pages).

*Primary Examiner* — Emmanuel Duke

(57) ABSTRACT

Disclosed is an icemaker for a refrigerator, comprising: a tray for containing water to make the water into ice pieces having a predetermined shape; a water supply unit installed at one side of the tray, for supplying water to the tray; a drive unit installed to face the water supply unit with the tray being interposed therebetween; an ice separating lever rotatably assembled between the drive unit and the water supply unit to be rotated by a motor installed in the drive unit; and an ice separating heater for applying heat to the tray so that ice pieces are separated from the tray. The drive unit includes a drive unit housing, a driving motor having a driving gear, a slave gear having a rotary cam and a first magnet and coupled to a rotary shaft of the ice separating lever, a cantilever having a second magnet and rotated by the rotary cam, and first and second Hall elements corresponding to the first and second magnets, respectively.

10 Claims, 9 Drawing Sheets

(56) References Cited

FOREIGN PATENT DOCUMENTS

| | | | | | |
|---|---|---|---|---|---|
| KR | 10-2006-0007245 | | 1/2006 | | |
| KR | 10-0565381 | | 3/2006 | | |
| KR | 100565381 | * | 3/2006 | ..... | F25C 1/10 |
| KR | 100565381 B1 | * | 6/2006 | ..... | F25C 1/00 |
| KR | 10-2010-0138374 | | 12/2010 | | |

* cited by examiner

18

19

20

22

23

24

ICE MAKER FOR A REFRIGERATOR

TECHNICAL FIELD

The present invention relates to an icemaker for a refrigerator, and more particularly to an icemaker for a refrigerator which shuts off electric power of an ice separating heater when ice pieces are completely separated, and effectively detects a full state of the ice pieces to stop an ice making function.

BACKGROUND ART

In general, a refrigerator is adapted to preserve foods stored therein for a long time without modifying the foods as air in the refrigerator is cooled by using a cooling cycle.

The refrigerator includes a body for defining a receiving space divided into a refrigerating compartment and a freezing compartment therein, and doors mounted to one side of the body, for opening/closing the refrigerating compartment and the freezing compartment. A machine apparatus including a compressor, a condenser, an evaporator, and the like, for forming a freezing cycle is provided in the body.

An icemaker may be installed in a freezing compartment, and an example of such an icemaker is disclosed in Korean Unexamined Patent Publication No. 10-2006-0007245 (hereinafter, referred to as 'the related art').

As shown in FIGS. 1 and 2, the icemaker according to the related art includes an ice making unit 8 mounted to an upper portion of an inner side of a freezing compartment F to making supplied water into ice pieces by using cooling air in the freezing compartment F, an ice bank 9 mounted to an inner side of the freezing compartment F so that the ice pieces made by the ice making unit 8 can be separated and contained therein, a dispenser 10 mounted to the freezing compartment door 4, for withdrawing the ice pieces to the outside without opening/closing the freezing compartment door 4, and an ice chute 11 for guiding the ice pieces contained in the ice bank 9 so that the ice pieces drop into the dispenser 10.

The ice making unit 8 includes a tray 12 formed of aluminum, for containing water for ice making to make ice pieces having a predetermined shape, a water supply unit 14 for supplying water into the tray 12, a separation lever 16 for separating the ice pieces made in the tray 12, a slider 20 for dropping the ice pieces separated by the ice separating lever 16 into the ice bank 9, and a control unit 22 for controlling supply of water to the water supply unit 14 and controlling the ice separating lever 16.

The ice separating lever 16 is configured such that a shaft 16*a* thereof crosses a central upper side of the tray 12, and a plurality of pins 16*b* for pushing out ice pieces protrude from a side surface of the shaft 16*a*.

Although not shown, an ice separating heater (not shown) is mounted to a lower end of the tray 12 to heat ice pieces made in the tray 12 and easily separate the ice pieces through the ice separating lever 16.

However, electric power of the icemaker for a refrigerator according to the related art is interrupted if the ice separating heater reaches a predetermined temperature, but only after completion of ice making.

Accordingly, since the made ice pieces are separated from the tray when electric power of the ice separating heater is interrupted early due to various conditions, the ice separating lever compulsorily performs an ice separating operation, causing a breakdown due to a damage, and when electric power of the ice separating heater is interrupted after lapse of a predetermined time from the completion of ice making, a safety accident may be generated due to an overheat and much electric power may be consumed.

Further, if ice pieces are unnaturally stacked in the ice bank, a full state may be continuously repeated as the full state cannot be detected even in the case of a full state, and an operation of the ice maker is finally stopped by the ice pieces.

Meanwhile, a full state lever installed in a cantilever of an icemaker, for identifying an amount of ice pieces and operating or stopping an ice maker has been developed and used.

DISCLOSURE

Technical Problem

An aspect of the present invention is to provide an icemaker for a refrigerator which accurately interrupts electric power of an ice separating heater at a time point when ice separation is completed, and effectively detects a full state of ice pieces to stop an ice making function, and a method of controlling the ice maker for a refrigerator.

Another aspect of the present invention is to provide an icemaker for a refrigerator which provides a shape of a cam for operating a full state lever with several strokes to effectively perform a detection operation of the full state lever generated during ice separation, preventing the full state lever from being constrained.

Technical Solution

In accordance with one aspect of the present invention, there is provided an icemaker for a refrigerator, comprising: includes a tray for containing water to make the water into ice pieces having a predetermined shape; a water supply unit installed at one side of the tray, for supplying water to the tray; a drive unit installed to face the water supply unit with the tray being interposed therebetween; an ice separating lever rotatably assembled between the drive unit and the water supply unit to be rotated by the drive unit; and an ice separating heater for applying heat to the tray so that ice pieces are separated from the tray, wherein the drive unit includes a drive unit housing, a driving motor having a driving gear, a slave gear having a rotary cam and a first magnet and coupled to a rotary shaft of the ice separating lever, a cantilever having a second magnet and rotated by the rotary cam, and first and second Hall elements corresponding to the first and second magnets, respectively.

The cantilever has an upper end having the second magnet and a lower end bent about a center of rotation thereof, and a rod protrudes from the bent lower end toward the rotary cam.

If the first magnet and the first Hall element start to contact each other, an initial position of the ice separating lever is detected and ice making begins.

If the contact of the second magnet and the second Hall element is separated, it is determined that the ice pieces are in a full state and electric power of the ice separating heater is interrupted by the detected temperature.

If the contact of the second magnet and the second Hall element is separated while the first magnet contacts the first Hall element, it is determined that the ice pieces are in a full state and ice making is stopped.

A return spring for applying a resilient force is installed in the rod of the cantilever so that a contact of the second magnet and the second Hall element can be maintained.

A coupling member is further installed in the drive unit housing, and a stopping member is formed in the coupling member to be coupled to the return spring.

A full state lever for identifying an amount of ice pieces to operate or stop the ice maker is connected to the cantilever, and a position of the full state lever is determined according to a position of a free end of the cantilever.

The rotary cam includes a first circumferential position where a first radius starts, a second circumferential position spaced counterclockwise apart from the first circumferential position by a first angle and where the first radius ends and a second radius larger than the first radius starts, a third circumferential position spaced counterclockwise apart from the second circumferential position by a second angle, where the second radius ends, and having a protrusion having a third radius larger than the second radius, and a fourth circumferential position spaced counterclockwise apart from the third circumferential position by a third angle and where a fourth radius larger than the second radius starts and, ending at the first circumferential position.

As the rotary cam rotates clockwise, when a free end of the rod of the cantilever contacts the rotary cam between the first circumferential position and the second circumferential position, the free end is located at a top point, when the free end of the rod contacts the rotary cam between the second circumferential position and the third circumferential position, the free end is located at a descending position, when the free end of the rod contacts the rotary cam at the third circumferential position, the free end reaches a first bottom point, the free is located is located at the descending position between the third circumferential position and the fourth circumferential position, and the free end reaches a second bottom point between the fourth circumferential position and the first circumferential position.

As the rotary cam rotates clockwise, when the free end of the rod of the cantilever is located at the top point, a free end of the full state lever is located at a bottom point, when the free end of the rod of the cantilever is located at the descending position, the free end of the full state lever is located at the ascending position, and when the free end of the rod of the cantilever is located at the first and second bottom points, the free end of the full state lever is located at first and second high points, respectively.

Advantageous Effects

Accordingly, the ice maker for a refrigerator of the present invention can accurately interrupts electric power of an ice separating heater at a time point when ice making is completed, and effectively detect a full state of ice pieces to stop an ice making function.

Further, a full state lever can be prevented from being constrained by providing a shape of a camp for operating the full state lever with two strokes to effectively perform a detection operation of the full state lever. In particular, ice pieces can be prevented from being caught by the full state lever differently according to the stack shapes of the ice pieces, and thus an error is prevented.

BEST MODE

Hereinafter, an exemplary embodiment of the present invention will be described in detail with reference to the accompanying drawings.

Figure 1:
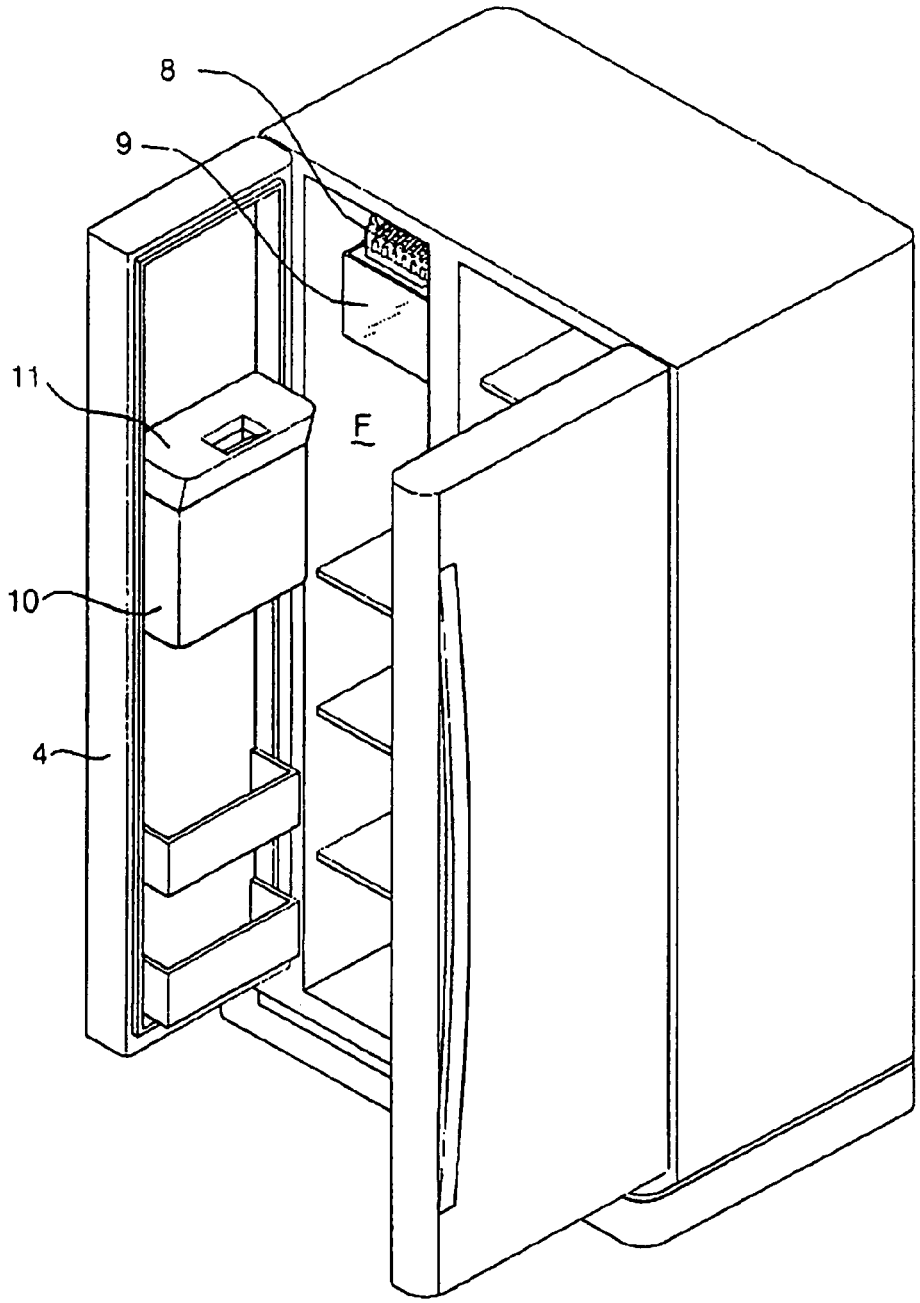
FIG.1 (PRIOR ART)
FIG. 1 is a perspective view showing a refrigerator according to the related art.
Figure 2:
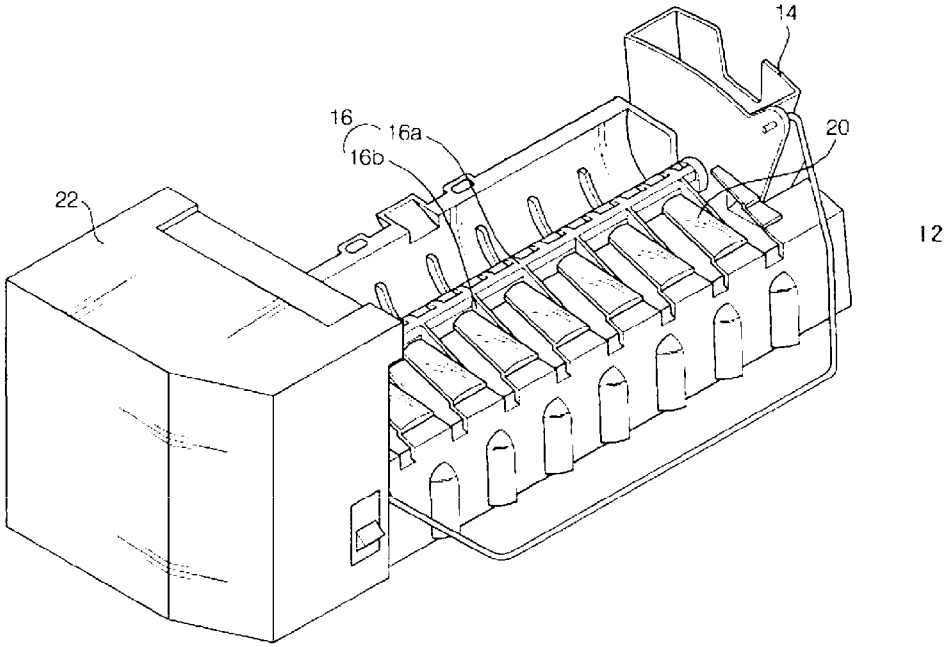
FIG. 2 is a perspective view showing an icemaker for a refrigerator according to the related art.
Figure 3:
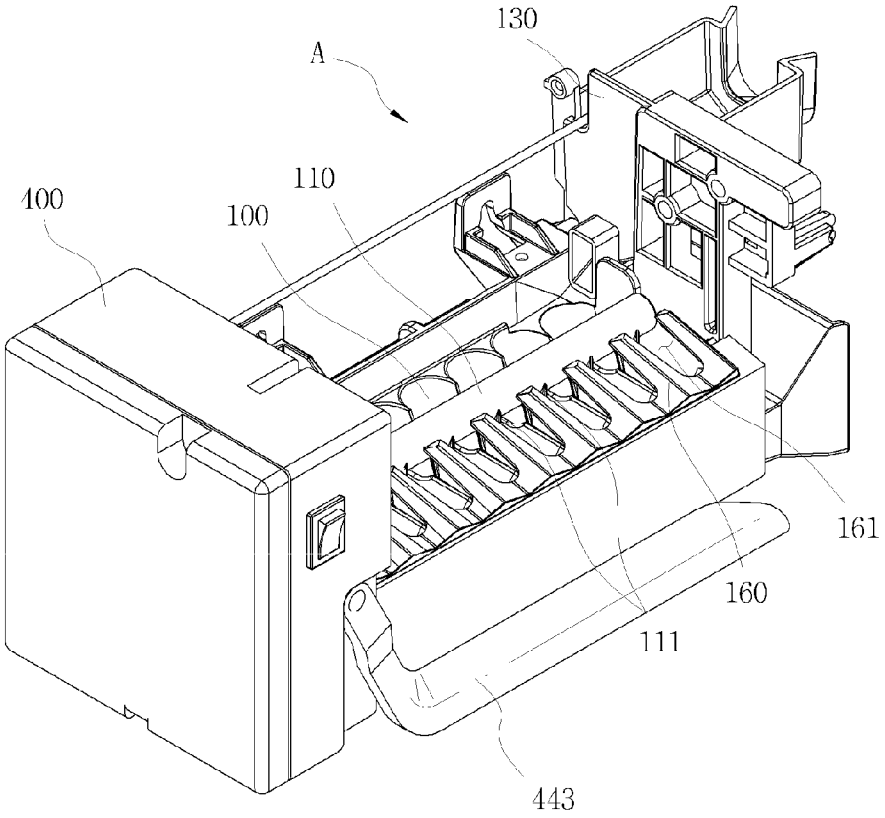
FIG. 3 is a schematic perspective view showing an icemaker for a refrigerator according to the present invention.
Figure 4:
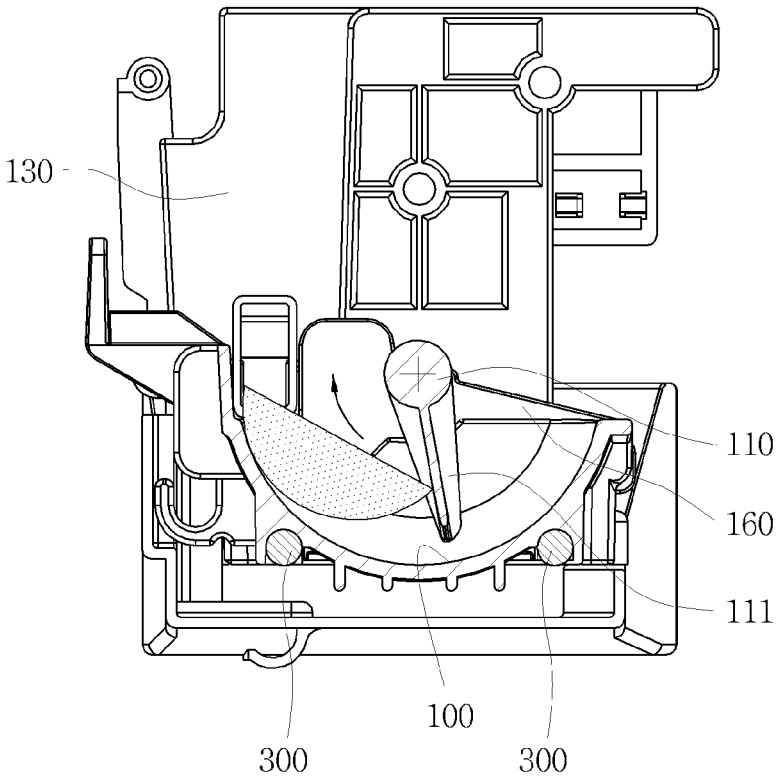
FIG. 4 is a side sectional view schematically showing the icemaker for a refrigerator of FIG. 3.
Figure 5:
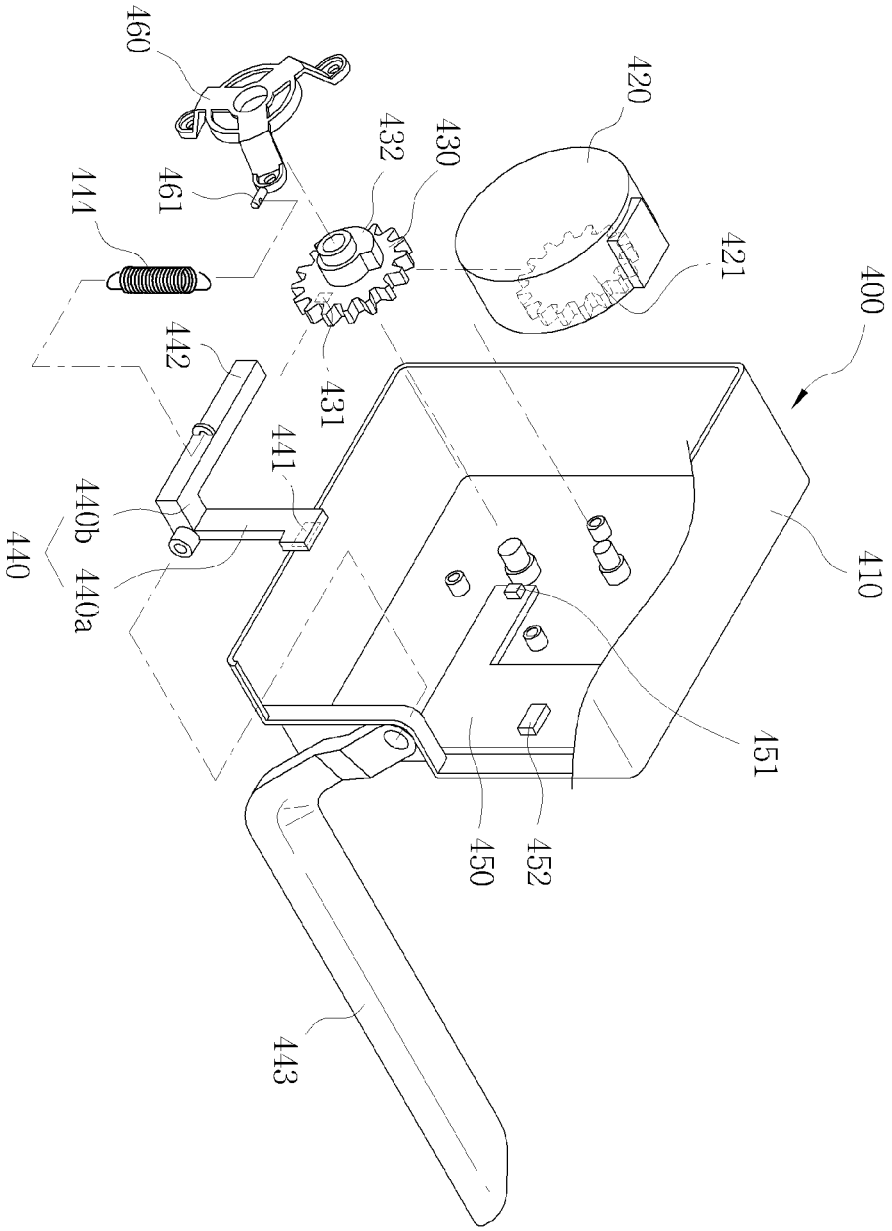
FIG. 5 is an exploded perspective view schematically showing a drive unit of FIG. 3.
Figure 6:
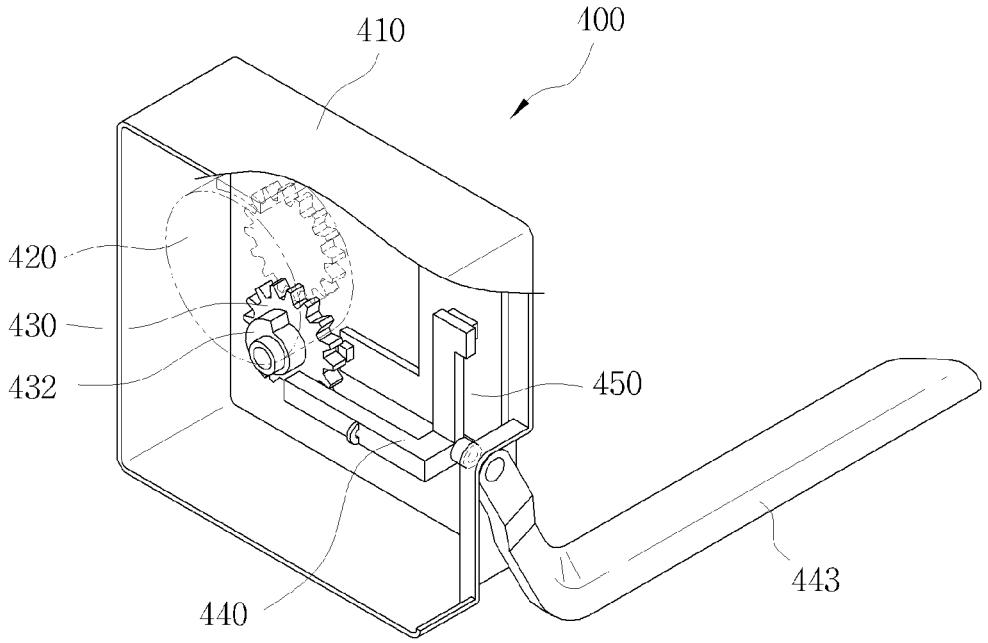
FIGS. 6 and 7 are schematic perspective views showing an operation of the drive unit.
Figure 7:
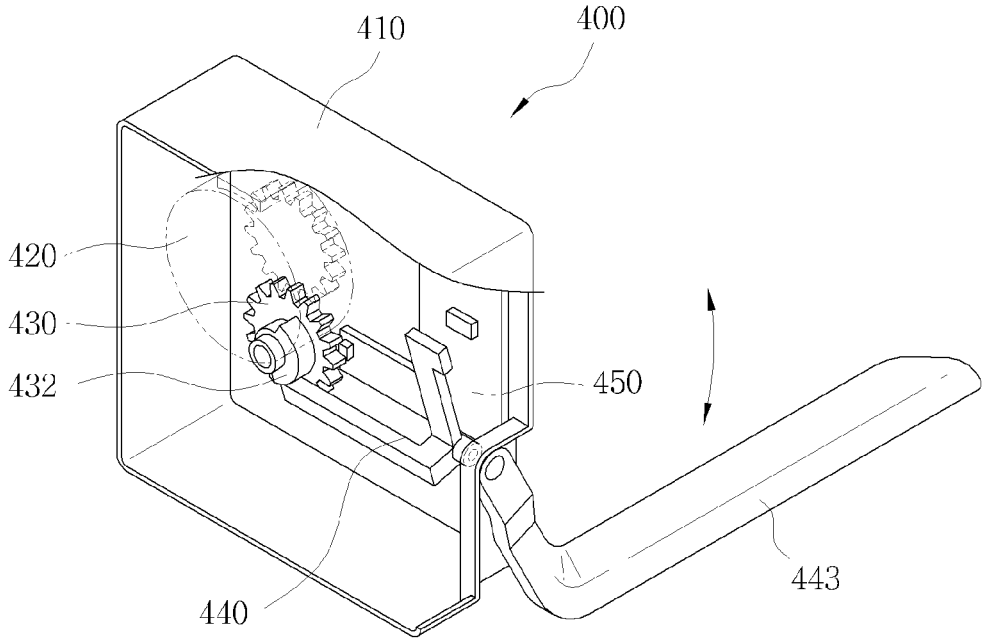
Figure 8:
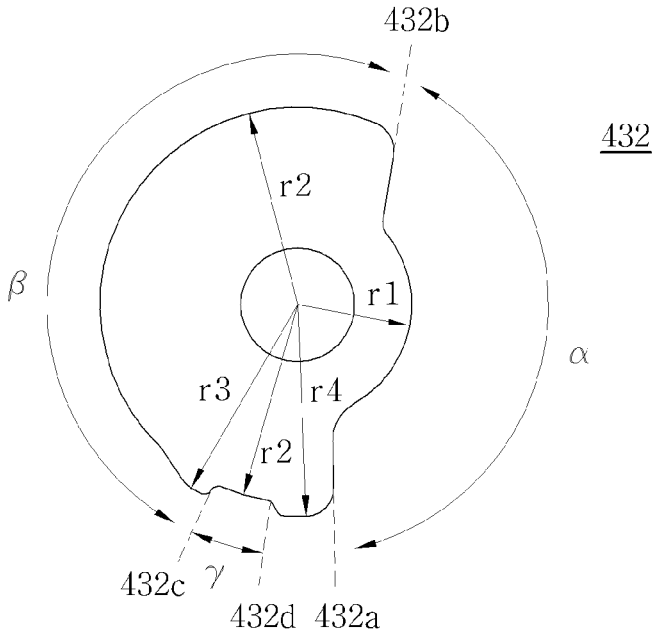
FIG. 8 is a view showing a sectional shape of a rotary cam of the icemaker for a refrigerator according to the present invention.
Figure 9:
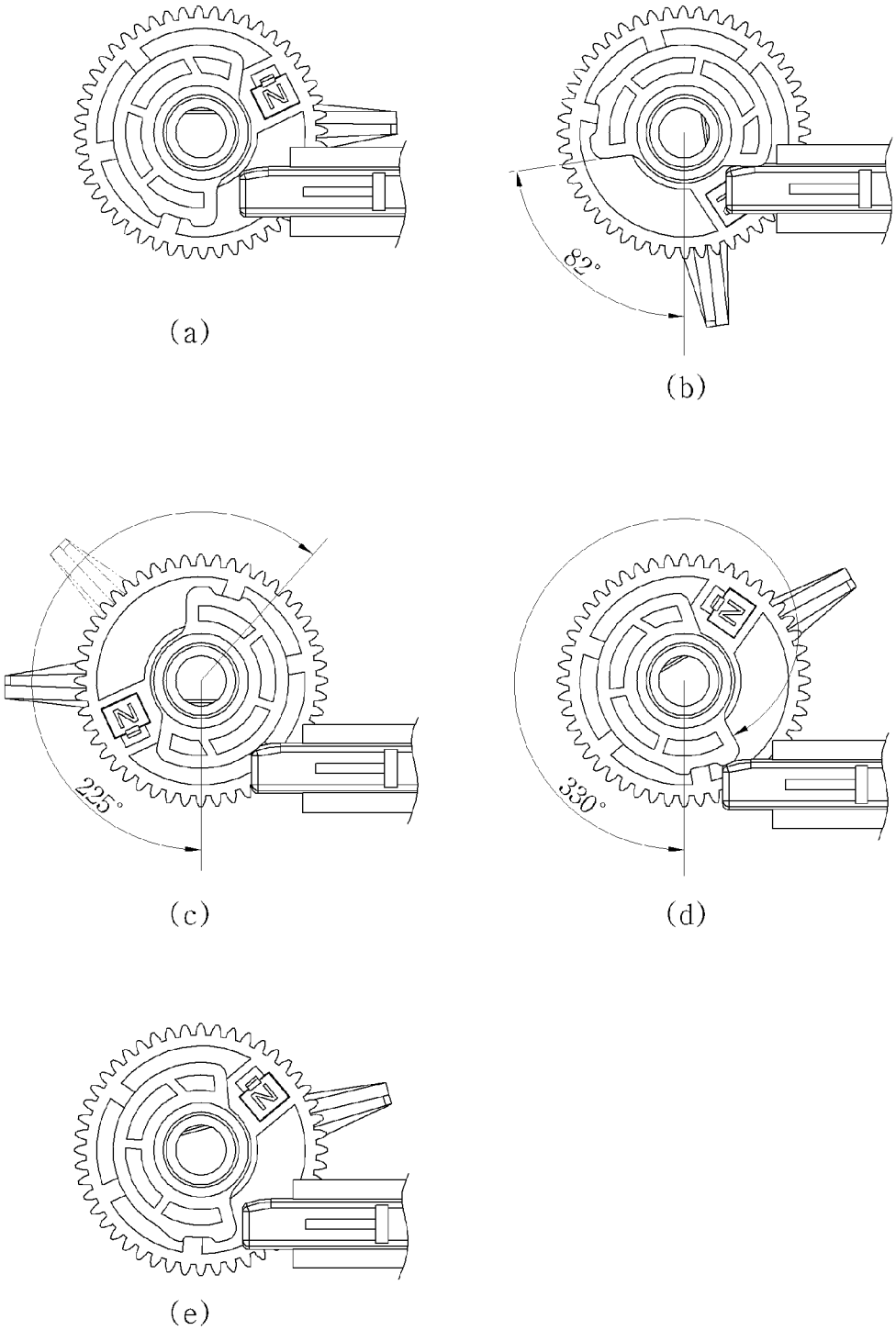
FIG. 9 is a view showing an operation of the rotary cam of FIG. 8 and a rod of a cantilever.

FIG. 3 is a schematic perspective view showing an icemaker for a refrigerator according to the present invention. FIG. 4 is a side sectional view schematically showing the icemaker for a refrigerator of FIG. 3. FIG. 5 is an exploded perspective view schematically showing a drive unit of FIG. 3. FIGS. 6 and 7 are schematic perspective views showing an operation of the drive unit. FIG. 8 is a view showing a sectional shape of a rotary cam of the icemaker for a refrigerator according to the present invention. FIG. 9 is a view showing an operation of the rotary cam of FIG. 8 and a rod of a cantilever.

As shown in FIGS. 3 to 7, the icemaker A for a refrigerator according to the present invention includes a tray 100 for containing water to make the water into ice pieces having a predetermined shape, a water supply unit 130 installed at one side of the tray 100, for supplying water to the tray 100, a drive unit 400 installed to face the water supply unit 130 with the tray 100 being interposed therebetween, and an ice separating lever 110 rotatably assembled between the drive unit 400 and the water supply unit 130 to be rotated by a motor 420 installed in the drive unit 400.

A plurality of pins 111 for pushing out ice pieces from the tray 100 are integrally formed with the ice separating lever 110.

An ice storage unit (not shown) for preserving the made ice pieces is installed at a lower portion of the tray 100.

In this case, the pins 111 formed in the ice separating lever 110 are formed along a lengthwise direction of the ice separating lever 110 at an interval corresponding to partitions of the tray 100.

A cover 160 for covering an upper portion of the tray 100 and guiding the made ice pieces to an ice storage unit (not shown) is additionally installed at one side of the ice separating lever 110.

Recesses 161 are formed in the cover 160 so that the pins 111 can pass through the recesses 161 while rotating.

Meanwhile, an ice separating heater 300 is further installed at a lower end of the tray 100, and the ice pieces contacting the tray 100 are partially melted by heat of the ice separating heater 300 and accordingly, can be easily separated from the tray 100.

The tray 100 is preferably formed of aluminum to easily transfer heat of the ice separating heater 300.

The drive unit 400 includes a drive unit housing 410, a driving motor 420 having a driving gear 421, a slave gear 430 having a rotary cam 432 and a first magnet 431 and coupled to a rotary shaft of the ice separating lever 110, a cantilever 440 having a second magnet 441 and rotated by the rotary cam 432, and first and second Hall elements 451 and 452 corresponding to the first and second magnets 431 and 441, respectively.

First, the first and second Hall elements 451 and 452 are installed in a printed circuit board 450 so as to correspond to positions of the first and second magnets 431 and 441 to measure magnetic forces of the first and second magnets 431 and 441.

The cantilever 440 has an upper end 440*a* having the second magnet 441 and a lower end 440*b* bent about a center of rotation thereof, and a rod 442 protrudes from the bent lower end 440*b* toward the rotary cam 432.

Referring to FIGS. 8 and 9, the rotary cam 432 includes a first circumferential position 432*a* where a first radius r1 starts, a second circumferential position 432*b* spaced counterclockwise apart from the first circumferential position 432*a* by a first angle α and where the first radius r1 ends and a second radius r2 larger than the first radius r1 starts, a third circumferential position 432*c* spaced counterclockwise apart from the second circumferential position 432*b* by a second angle β, where the second radius r2 ends, and having a protrusion having a third radius r3 larger than the second radius r2, and a fourth circumferential position 432*d* spaced counterclockwise apart from the third circumferential position 432*c* by a third angle γ and where a fourth radius r4 larger than the second radius r2 starts and, the second radius ending at the first circumferential position 432*a*. Accordingly, as the rotary cam 432 rotates clockwise, when a free end of the rod 442 of the cantilever 440 contacts the rotary cam 432 between the first circumferential position 432*a* and the second circumferential position 432*b*, the free end is located at a top point, when the free end of the rod 442 contacts the rotary cam 432 between the second circumferential position 432*b* and the third circumferential position 432*c*, the free end is located at a descending position, when the free end of the rod 442 contacts the rotary cam 432 at the third circumferential position 432*c*, the free end reaches a first bottom point, the free end is located at the descending position between the third circumferential position 432*c* and the fourth circumferential position 432*d*, and the free end reaches a second bottom point between the fourth circumferential position 432*d* and the first circumferential position 432*a*.

Although FIG. 9 shows the positions of the rotary cam with detailed angles as an example, it is merely an exemplary embodiment and does not limit the scope of the present invention.

If the first magnet 431 contacts the first Hall element 451, an initial position of the ice separating lever 110 is detected and an ice separating operation begins.

Moreover, if the contact of the second magnet 441 and the second Hall element 452 is separated, electric power of the ice separating heater 300 is interrupted.

Meanwhile, a full state lever 443 for identifying an amount of ice pieces to operate or stop the ice maker is connected to the cantilever 440, and the full state lever 443 is coupled to a center of rotation of the cantilever 440.

Then, when the free end of the rod 442 of the cantilever 440 is located at the top point, the free end of the full state lever 443 is located at the bottom point, when the free end of the rod 442 of the cantilever 440 is located at the descending position, the free end of the full state lever 443 is located at the ascending position, and when the free end of the rod 442 of the cantilever 440 is located at the first and second bottom points, the free end of the full state lever 443 are located at first and second high points, respectively.

If the contact of the second magnet 441 and the second Hall element 452 is separated by the full state lever 443 while the first magnet 431 contact the first Hall element 451, it is determined that the ice pieces are in a full state and ice making is stopped.

As a result, the electric power of the ice separating heater 300 may be interrupted or connected according to a contact of the second magnet 441 and the second Hall element 452, and a full state of the ice pieces can be detected.

A return spring 444 for applying a resilient force so that a contact of the second magnet 441 and the second Hall element 452 can be maintained when the rotary cam 432 and the rod 442 of the cantilever 440 do not contact each other is installed in the cantilever 440.

A coupling member 460 may be further installed in the drive unit housing 410, and a stopping member 461 may be formed in the coupling member 460 to be engaged with the return spring 444. Meanwhile, the return spring 444 may be directly connected to the drive unit housing 410.

Hereinafter, an operation of the icemaker A for a refrigerator will be described.

First, if the first magnet 431 contacts the first Hall element 451, an initial position of the ice separating lever 110 is detected and ice making begins.

Thereafter, if a ice making condition (temperature and time) is satisfied, a microcomputer (control unit) determines that ice making is completed and the ice separating heater 300 applies heat to the tray 100 to separate ice pieces from the tray 100. Then, the second magnet 441 and the second Hall element 452 remain in contact with each other.

Further, electric power is applied to the motor 420 and the ice separating lever 110 is rotated so that the ice pieces start to be separated, and the rotary cam 432 of the slave gear 430 is also rotated at the same time.

Thereafter, if the rotary cam 432 pushes the rod 442 of the cantilever 440 to a lower side, the contact of the second magnet 441 and the second Hall element 452 is separated and thus the electric power of the ice separating heater 300 is interrupted. Next, the rotary cam 432 is additionally rotated while the rod 442 is pushed to the lower side to complete separation of ice pieces.

When the rod 442 is separated from the rotary cam 432, a force is applied to the cantilever 440 by the return spring 444 to return the cantilever 440.

This state is an initial state, in which the first magnet 431 contacts the first Hall element 451.

Then, if the contact of the second magnet 441 and the second Hall element 452 is released and it is determined that the state is a full state, an operation of the ice maker A is stopped, and if the second magnet 441 and the second Hall element 452 remain in contact with each other and it is determined that the state is not a full state, the above operation is repeated.

Meanwhile, according to the present invention, as the rotary cam 432 rotates clockwise, when a free end of the rod 442 of the cantilever 440 contacts the rotary cam 432 between the first circumferential position 432*a* and the second circumferential position 432*b*, the free end is located at a top point, when the free end of the rod 442 contacts the rotary cam 432 between the second circumferential position 432*b* and the third circumferential position 432*c*, the free end is located at a descending position, when the free end of the rod 442 contacts the rotary cam 432 at the third circumferential position 432*c*, the free end reaches a first bottom point, the free end is located at the descending position between the third circumferential position 432*c* and the fourth circumferential position 432*d*, and the free end reaches a second bottom point between the fourth circumferential position 432*d* and the first circumferential position 432*a*.

Figure 10:
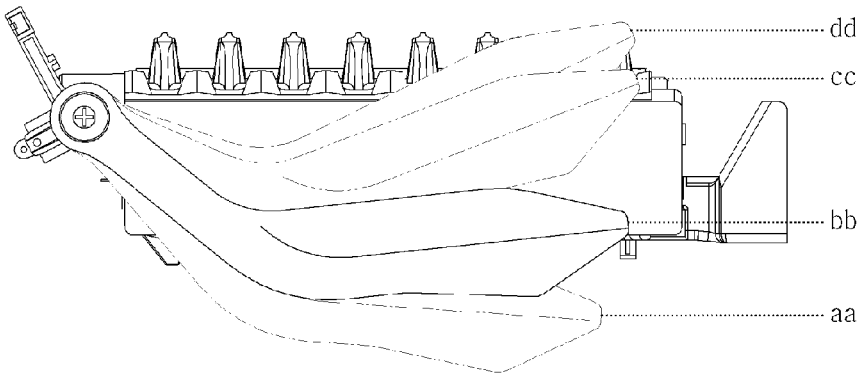
FIG. 10 is a view showing an operation of a full state lever of the ice maker for a refrigerator according to the present invention.

FIG. 10 is a view showing an operation of a full state lever of the ice maker for a refrigerator according to the present invention.

Referring to FIG. 10, when the free end of the rod 442 is located at the top point, the free end of the full state lever 443 connected to the cantilever 440 is located at a bottom point aa, when the free end of the rod 442 is located at the descending position, the free end of the full state lever 443 is located at a ascending position bb, if the free end of the rod 442 reaches the first bottom point, the free end of the full state lever 443 reaches a first high point cc, if the free end of the rod 442 is located at the descending position again, the free end of the full state lever 443 is located at the ascending position bb again, and if the free end of the rod 442 reaches the second bottom point, the free end of the full state lever 443 reaches a second high point dd and then returns to the bottom point aa.

In this way, as the free end of the full state lever 443 undergoes a cycle of the bottom point aa-the ascending position bb-the first top point cc-the ascending position bb-the second top point dd-the bottom point aa, it forms a two-stroke cycle having two high points.

In this way, as the full state lever 443 performs the two-stroke cycle having two top points, the full state lever 443 performs an operation of rapidly ascending two time and dropping to prevent the full state lever 443 from failing to properly detect a full state even when ice pieces are stacked unnaturally.

The invention claimed is:

1. An icemaker for a refrigerator, comprising: a tray for containing water to make the water into ice pieces having a predetermined shape; a water supply unit installed at one side of the tray, for supplying water to the tray; a drive unit installed to face the water supply unit with the tray being interposed therebetween; an ice separating lever rotatably assembled between the drive unit and the water supply unit to be rotated by the drive unit; and an ice separating heater for applying heat to the tray so that ice pieces are separated from the tray, wherein the drive unit includes a drive unit housing, a driving motor having a driving gear, a slave gear having a rotary cam and a first magnet and coupled to a rotary shaft of the ice separating lever, a cantilever having a second magnet and rotated by the rotary cam, and a first element and a second hall element corresponding to the first and second magnets, respectively, wherein the cantilever has an upper end having the second magnet and a lower end bent about a center of rotation thereof, and a rod protruding from the bent lower end toward the rotary cam, and the upper end and the lower end are fixed to each other and rotate together according to reciprocal rotation of the rotary cam, the upper end moves towards or moves away from the inner surface of the drive unit housing in which a printed circuit board is installed.

2. The icemaker of claim 1, wherein if the first magnet and the first Hall element start to contact each other, an initial position of the ice separating lever is detected and ice making begins.

3. The icemaker of claim 1, wherein if the contact of the second magnet and the second Hall element is separated, it is determined that the ice pieces are in a full state and electric power of the ice separating heater is interrupted by the detected temperature.

4. The icemaker of claim 3, wherein the rotary cam includes a first circumferential position where a first radius starts, a second circumferential position spaced counterclockwise apart from the first circumferential position by a first angle and where the first radius ends and a second radius larger than the first radius starts, a third circumferential position spaced counterclockwise apart from the second circumferential position by a second angle, where the second radius ends, and having a protrusion having a third radius larger than the second radius, and a fourth circumferential position spaced counterclockwise apart from the third circumferential position by a third angle and where a fourth radius larger than the second radius starts and, ending at the first circumferential position.

5. The icemaker of claim 4, wherein as the rotary cam rotates clockwise, when a free end of the rod of the cantilever contacts the rotary cam between the first circumferential position and the second circumferential position, the free end is located at a top point, when the free end of the rod contacts the rotary cam between the second circumferential position and the third circumferential position, the free end is located at a descending position, when the free end of the rod contacts the rotary cam at the third circumferential position, the free end reaches a first bottom point, the free end is located at the descending position between the third circumferential position and the fourth circumferential position, and the free end reaches a second bottom point between the fourth circumferential position and the first circumferential position.

6. The icemaker of claim 5, wherein as the rotary cam rotates clockwise, when the free end of the rod of the cantilever is located at the top point, a free end of the full state lever is located at a bottom point, when the free end of the rod of the cantilever is located at the descending position, the free end of the full state lever is located at the ascending position, and when the free end of the rod of the cantilever is located at the first and second bottom points, the free end of the full state lever is located at first and second high points, respectively.

7. The icemaker of claim 1, wherein if the contact of the second magnet and the second Hall element is separated while the first magnet contacts the first Hall element, it is determined that the ice pieces are in a full state and ice making is stopped.

8. The icemaker of claim 1, wherein a return spring for applying a resilient force is installed in the rod of the cantilever so that a contact of the second magnet and the second Hall element can be maintained.

9. The icemaker of claim 8, wherein a coupling member is further installed in the drive unit housing, and a stopping member is formed in the coupling member to be coupled to the return spring.

10. The icemaker of claim 1, wherein a full state lever for identifying an amount of ice pieces to operate or stop the ice maker is connected to the cantilever, and a position of the full state lever is determined according to a position of a free end of the cantilever.

* * * * *